US012228313B2

(12) United States Patent
Aschow

(10) Patent No.: US 12,228,313 B2
(45) Date of Patent: Feb. 18, 2025

(54) REFRIGERATION SYSTEM WITH PARALLEL COMPRESSORS

(71) Applicant: Effecterra, Inc., Reno, NV (US)

(72) Inventor: Evan Aschow, Fair Oaks, CA (US)

(73) Assignee: Effecterra, Inc., Reno, NV (US)

( * ) Notice: Subject to any disclaimer, the term of this patent is extended or adjusted under 35 U.S.C. 154(b) by 343 days.

(21) Appl. No.: 17/687,277

(22) Filed: Mar. 4, 2022

(65) Prior Publication Data

US 2023/0280072 A1 Sep. 7, 2023

(51) Int. Cl.
*F25B 1/10* (2006.01)
*F25B 9/00* (2006.01)

(52) U.S. Cl.
CPC ..... *F25B 1/10* (2013.01); *F25B 9/008* (2013.01); *F25B 2309/061* (2013.01); *F25B 2400/075* (2013.01); *F25B 2400/13* (2013.01)

(58) Field of Classification Search
CPC .. F25B 1/10; F25B 9/008; F25B 41/20; F25B 41/40; F25B 2313/02731; F25B 2313/02732; F25B 2400/075; F25B 2400/13; F25B 2600/25; F25B 2600/2507
See application file for complete search history.

(56) References Cited

U.S. PATENT DOCUMENTS 10,352,604 B2 * 7/2019 Zha ..... F25B 49/022
11,162,388 B1 * 11/2021 Snyder ..... F25B 25/005

FOREIGN PATENT DOCUMENTS

CN 117588862 A * 2/2024

OTHER PUBLICATIONS

Escudier, M., & Atkins, T. (2019). degrees of superheat. In A Dictionary of Mechanical Engineering. : Oxford University Press. Retrieved Apr. 5, 2024, from https://www.oxfordreference.com/view/10.1093/acref/9780198832102.001.0001/acref-9780198832102-e-1378. (Year: 2019).*

Escudier, M., & Atkins, T. (2019). duty cycle. In A Dictionary of Mechanical Engineering. : Oxford University Press. Retrieved Apr. 5, 2024, from https://www.oxfordreference.com/view/10.1093/acref/9780198832102.001.0001/acref-9780198832102-e-1729. (Year: 2019).*

* cited by examiner

*Primary Examiner* — Miguel A Diaz
(74) *Attorney, Agent, or Firm* — Foley & Lardner LLP

(57) ABSTRACT

A method for controlling a three-way valve that diverts return refrigerant from a first compressor to a second compressor or a third compressor, the second and third compressor in parallel includes obtaining a temperature of the return refrigerant indicating a degree of superheat of the return refrigerant. The method also includes determining if the three-way valve should be transitioned into a first position, transitioned into a second position, or maintained in a current one of the first position or the second position. The method also includes transitioning the three-way valve into the first position or the second position, or maintaining the three-way valve in the first position or the second position. In the first position, the first compressor provides the return refrigerant to the second compressor through the three-way valve and in the second position, the first compressor provides the return refrigerant to the third compressor through the three-way valve.

20 Claims, 4 Drawing Sheets

REFRIGERATION SYSTEM WITH PARALLEL COMPRESSORS

BACKGROUND

The present disclosure relates generally to a refrigeration system with parallel compression systems. More particularly, the present disclosure relates to carbon dioxide (CO2) compression systems.

SUMMARY

One implementation of the present disclosure is a refrigeration system for cooling a space, according to some embodiments. In some embodiments, the refrigeration system includes a first compressor, a second compressor, a third compressor, and a three-way valve. In some embodiments, the first compressor is fluidly coupled with a heat exchanger. In some embodiments, the first compressor is configured to receive a refrigerant from the heat exchanger and pressurize the refrigerant. In some embodiments, the second compressor and the third compressor are arranged in a parallel configuration. In some embodiments, the three-way valve is fluidly coupled with an outlet of the first compressor and fluidly coupled with an inlet of each of the second compressor and the third compressor. In some embodiments, the three-way valve is selectively operable between a first position in which an outlet of the first compressor is fluidly coupled with an inlet of the second compressor through the three-way valve, and a second position in which the outlet of the first compressor is fluidly coupled with an inlet of the third compressor through the three-way valve. In some embodiments, the three-way valve is configured to selectively transition between the first position and the second position in response to a temperature of the refrigerant.

In some embodiments, the refrigeration system is a carbon dioxide (CO2) refrigeration system and the refrigerant is CO2. In some embodiments, the heat exchanger is a low temperature heat exchanger of a low temperature circuit. In some embodiments, the refrigeration system further includes a medium temperature circuit having a medium temperature heat exchanger. In some embodiments, the low temperature heat exchanger is configured to cool a low temperature zone to a low temperature. In some embodiments, the medium temperature heat exchanger is configured to cool a medium temperature zone to a medium temperature. In some embodiments, the low temperature is less than the medium temperature.

In some embodiments, the inlet of the second compressor is fluidly coupled with a return of the medium temperature circuit, the second compressor configured to receive refrigerant from the return of the medium temperature circuit when the three-way valve is in the first position and when the three-way valve is in the second position.

In some embodiments, the three-way valve is configured to selectively transition between the first position and the second position to provide return refrigerant from the low temperature circuit to the second compressor or the third compressor.

In some embodiments, both the second compressor and the third compressor are configured to pressurize the refrigerant and provide the refrigerant to both the medium temperature heat exchanger and the low temperature heat exchanger. In some embodiments, the low temperature zone is a freezer zone of a display case, and the medium temperature zone is refrigerated zone of the display case.

In some embodiments, the refrigeration system further includes a temperature sensor, and a controller. In some embodiments, the controller is configured to obtain the temperature from the temperature sensor. In some embodiments, the temperature indicates a degree of superheat of the refrigerant. In some embodiments, the controller is further configured to determine whether the three-way valve should be in the first position or the second position based on the temperature, and operate the three-way valve to transition between the first position and the second position.

Another implementation of the present disclosure is a control system for a refrigeration system, according to some embodiments. In some embodiments, the control system includes a three-way valve, a temperature sensor, and a controller. In some embodiments, an inlet of the three-way valve configured to fluidly couple with an outlet of a first compressor. In some embodiments, the first compressor is configured to receive return refrigerant from a heat exchanger. In some embodiments, the three-way valve is transitionable between a first position in which the three-way valve provides the refrigerant provided by the first compressor to a second compressor, and a second position in which the three-way valve provides the refrigerant provided by the first compressor to a third compressor. In some embodiments, the second compressor and third compressor are arranged in parallel. In some embodiments, the temperature sensor is positioned at an inlet of the second compressor. In some embodiments, the temperature sensor is configured to measure a temperature indicating a degree of superheat of the refrigerant before entering the second compressor. In some embodiments, the controller is configured to obtain the temperature from the temperature sensor, and operate the three-way valve to transition between the first position and the second position based on the temperature.

In some embodiments, the controller is further configured to compare the temperature to a first threshold value. In some embodiments, the controller is configured to operate the three-way valve to transition into the second position in response to the temperature exceeding the first threshold value. In some embodiments, the controller is configured to compare the temperature to a second threshold value and operate the three-way valve to transition into the first position in response to the temperature being less than the second threshold value.

In some embodiments, the controller is further configured to compare the temperature to a first threshold value and a second threshold value. In some embodiments, the controller is configured to maintain the three-way valve in a current one of the first position or the second position in response to the temperature being both less than the first threshold value and greater than the second threshold value. In some embodiments, the controller is configured to operate the three-way valve to transition between the first position and the second position in response to the temperature being greater than the first threshold value or less than the second threshold value.

In some embodiments, the temperature sensor is positioned downstream of the three-way valve. In some embodiments, the temperature sensor is positioned at an inlet of the second compressor. In some embodiments, the temperature sensor is positioned at an inlet of the third compressor. In some embodiments, the controller is configured to determine or adjust a duty cycle based on the temperature, and operate the three-way valve based on the duty cycle. In some embodiments, the duty cycle defines an amount of time the three-way valve is in the first position relative to an amount of time the three-way valve is in the second position. In some embodiments, the controller is configured to transition the three-way valve between the first position and the second position to direct superheated refrigerant between the second compressor and the third compressor to reduce a degradation rate of the second compressor.

Another implementation of the present disclosure is a method for controlling a three-way valve that selectively diverts return refrigerant from a first compressor to a second compressor or a third compressor, the second and third compressor in parallel, according to some embodiments. In some embodiments, the method includes obtaining a temperature of refrigerant entering the second compressor or the third compressor. In some embodiments, the temperature indicates a degree of superheat of the refrigerant. In some embodiments, the method also includes determining if the three-way valve should be transitioned into a first position, transitioned into a second position, or maintained in a current one of the first position or the second position. In some embodiments, the method also includes transitioning the three-way valve into the first position or the second position, or maintaining the three-way valve in the first position or the second position. In some embodiments, in the first position, the first compressor provides the return refrigerant to the second compressor through the three-way valve. In some embodiments, in the second position, the first compressor provides the return refrigerant to the third compressor through the three-way valve.

In some embodiments, determining if the three-way valve should be transitioned into a first position, transitioned into a second position, or maintained in a current one of the first position or the second position includes comparing the temperature to a first threshold and, in response to the temperature exceeding the first threshold and the three-way valve being in the first position, determining that the three-way valve should be transitioned into the second position. In some embodiments, determining if the three-way valve should be transitioned into a first position, transitioned into a second position, or maintained in a current one of the first position or the second position includes comparing the temperature to a second threshold and, in response to the temperature being less than the second threshold and the three-way valve being in the second position, determining that the three-way valve should be transitioned into the first position.

In some embodiments, the return refrigerant is CO2. In some embodiments, the temperature is obtained from a temperature sensor positioned downstream of an outlet of the three-way valve.

In some embodiments, the method further includes determining or adjusting a duty cycle based on the temperature. In some embodiments, the method further includes operating the three-way valve based on the duty cycle. In some embodiments, the duty cycle defines an amount of time the three-way valve is in the first position relative to an amount of time the three-way valve is in the second position. In some embodiments, transitioning the three-way valve between the first position and the second position to direct the return refrigerant between the second compressor and the third compressor reduces a degradation rate of the second compressor.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the Figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Overview

Referring generally to the FIGURES, a refrigeration system includes a first compressor, and a second compressor and a third compressor in parallel. The first compressor is fluidly coupled in series with the second compressor and the third compressor that are fluidly coupled in parallel with each other. A three-way valve is positioned between the parallel compressors and the first compressor such that the three-way valve selectively fluidly couples the first compressor (e.g., an outlet of the first compressor) with the second compressor or the third compressor. A control system can include a controller and/or processing circuitry that controls the position of the three-way valve over time. The control system may also include a temperature sensor that is positioned downstream of a cooling circuit of the refrigeration system which feeds refrigerant into the first compressor. The controller may operate the three-way valve to transition between a first position in which the refrigerant from the first compressor is directed to the second compressor, and a second position in which the refrigerant from the first compressor is directed to the third compressor. The controller may operate the three-way valve based on the temperature obtained from the temperature sensor. According to some embodiments, the controller uses multiple temperature thresholds (e.g., a deadband technique) to determine when to transition the three-way valve between the first position and the second position.

Parallel Compression Refrigeration System

System Layout

Figure 1:
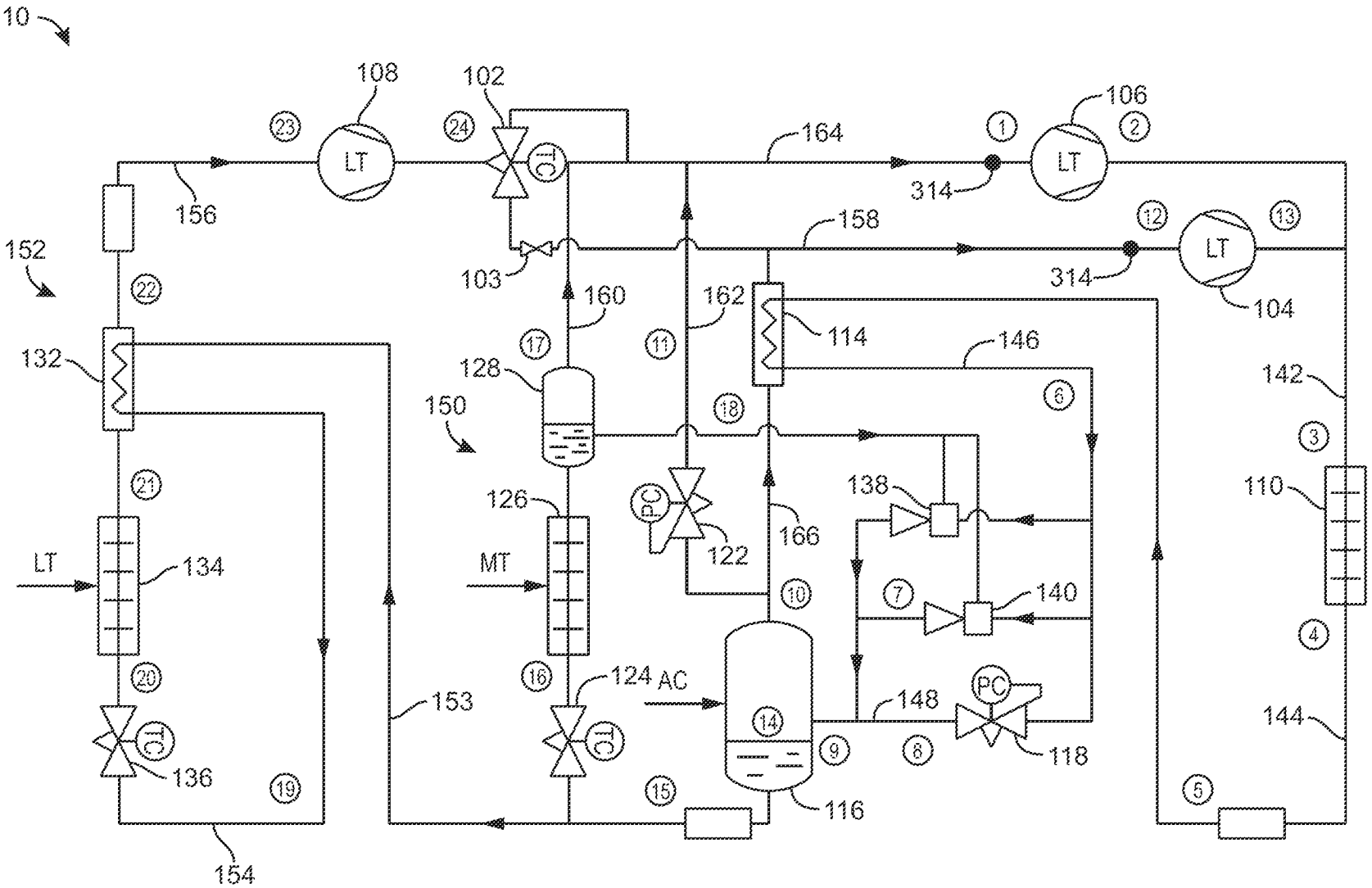
FIG. 1 is a block diagram of a refrigeration system having parallel compressors and a three-way valve for changing between the parallel compressors, according to some embodiments.

Referring to FIG. 1, a diagram of a refrigeration system 10 is shown, according to some embodiments. The refrigeration system 10 may be configured for use for a refrigerated display case, a refrigerated container, etc. The refrigeration system 10 can include multiple compressors in parallel for compressing and driving refrigerant through the system. In some embodiments, the refrigerant used in the refrigeration system 10 is carbon dioxide (CO2).

The refrigeration system 10 includes a medium temperature (MT) compressor 106 and an auxiliary or intermediate (IT) compressor 104, according to some embodiments. The MT compressor 106 and the IT compressor 104 can be operated (e.g., by a controller) to deliver gaseous refrigerant through the system 10. The MT compressor 106 and/or the IT compressor 104 operate to compress the gaseous CO2 and provide the gaseous CO2 to a heat exchanger 110 (e.g., a condenser) that is fluidly coupled with the MT compressor 106 and the IT compressor 104 via conduit 142 (e.g., piping, hose, a line, a tube, a tubular member, etc.). The gaseous CO2 may enter the heat exchanger 110 in a superheated gas phase, or a saturated vapor phase, pass through the heat exchanger 110, cool, condense into a saturated liquid or sub-cooled liquid phase, and exit the heat exchanger 110 as a liquid. The heat exchanger 110 may be a condenser configured to cool the gaseous CO2 into liquid CO2 as the CO2 passes through the heat exchanger 110.

The liquid CO2 may exit the heat exchanger 110 through conduit 144, and pass through a heat exchanger 114. The heat exchanger 114 is configured to facilitate a heat transfer between the liquid CO2 that exits the heat exchanger 110, and gaseous CO2 in a saturated vapor phase that exits a collection tank 116 (e.g., a flash tank) along a return line (e.g., conduit 166) to the IT compressor 104. The liquid CO2 in the conduit 144 may absorb heat from the gaseous CO2 being returned from the collection tank 116 to the IT compressor 104 so that the gaseous CO2 is transitioned into a saturated liquid/gas phase. The saturated liquid/gas CO2 exits the heat exchanger 114 via conduit 146 and enters a high pressure valve 118. The liquid/gas CO2 exits the high pressure valve 118 as a liquid/gas mixture, with more gas than liquid, and is provided into the collection tank 116. The collection tank 116 may function as a separator tank to separate the CO2 into liquid and gas. For example, liquid may collect at one end of the tank 116, while gas collects at an opposite end of the tank 116, thereby separating the CO2 into liquid and gas phases. The liquid CO2 is provided to both a medium temperature (MT) circuit 150 and a low temperature (LT) circuit 152 for use in providing refrigeration to a low temperature zone (e.g., a freezer) and a medium temperature zone (e.g., a refrigerator). The low temperature circuit 152 uses liquid CO2 provided by the tank 116 via conduit 153. The liquid CO2 may be provided via conduits 153, 154, and 156 through the low temperature circuit 152. The liquid CO2 passes through a heat exchanger 132 which facilitates heat exchange between the liquid CO2 in the conduit 153 and liquid CO2 in the conduit 156, downstream of a low temperature (LT) heat exchanger 134. The liquid CO2 is passed through a pressure reducing valve 136, so that the liquid CO2 is transitioned into a liquid/gas mixture at a reduced temperature before entering the LT heat exchanger 134. The CO2 is passed through the LT heat exchanger 134 to thereby cool the low temperature zone. When the CO2 exits the LT heat exchanger 134, the CO2 may be transitioned into a super-heated vapor phase. The superheated vapor CO2 is then passed through the heat exchanger 132 and provided to the LT compressor 108 via conduit 156 as a superheated vapor.

The superheated vapor CO2 is compressed by the LT compressor 108 and provided to a three-way valve 102, according to some embodiments. The three-way valve 102 is configured to alternatively direct CO2 to either the MT compressor 106 or the IT compressor 104 via conduit 164 or conduit 158, respectively. The conduit 164 that fluidly couples the three-way valve 102 with the MT compressor 106 is configured to receive gas from the MT circuit 150 via conduit 160, and receives gas from a gas output of the tank 116 via conduit 162. The operation of the MT compressor 106 and the IT compressor 104 can be synced with a position of the three-way valve 102 so that the MT compressor 106 operates to compress the CO2 when the three-way valve 102 is in a first position to provide the CO2 to the MT compressor 106, and so that the IT compressor 104 operate to compress the CO2 when the three-way valve 102 is in a second position to provide the CO2 to the IT compressor 104. A check-valve 103 is positioned at the outlet of the three-way valve 102 (e.g., downstream of the outlet of the three-way valve 102) along the conduit 158, between the outlet of the three-way valve 102 and the inlet of the IT compressor 104. Advantageously, the check-valve 103 may limit back-flow of CO2 into the three-way valve 102 when the three-way valve 102 transitions between positions.

Referring still to FIG. 1, the MT circuit 150 includes a pressure reducing valve 124, a MT heat exchanger 126, and an accumulator 128. Part of the liquid CO2 is provided to the pressure-reducing valve 124 from the liquid side of the tank 116. The liquid CO2 passes through the pressure reducing valve 124, and enters the MT heat exchanger 126 as a liquid-vapor phase. The MT heat exchanger 126 is configured to use the CO2 that enters the MT heat exchanger 126 to cool the MT zone (e.g., a refrigeration display case, or an area that does not need to be below the freezing point of water). The CO2 may absorb heat from air in the MT zone, thereby increasing a quality of the CO2 so that more, if not all, of the CO2 exiting the MT heat exchanger 126 is a vapor. The CO2 is then provided to the accumulator 128 where the CO2 may separate into a liquid portion and a gas portion. An outlet of the accumulator 128 is coupled with the inlet of the MT compressor 106 via conduit 160 and conduit 164 so that vapor CO2 of the accumulator 128 is provided to the MT compressor 106. A high pressure ejector 140 and a liquid ejector 138 are configured to remove CO2 from the accumulator 128 and recirculate the CO2 to an inlet of the tank 116. The high pressure ejector 140 and the liquid ejector 138 may be piped together with an outlet of the accumulator 128 and increase a coefficient of performance (COP) of the system 10 by reusing available liquid or vapor CO2 as an input to the tank 116 without requiring the available liquid or vapor CO2 to be re-compressed by the MT compressor 106. The high pressure ejector 140 may be configured to reuse available CO2 vapor (e.g., on warmer days) while the liquid pressure ejector 138 may be configured to reuse available CO2 liquid (e.g., on cooler days) to thereby increase the COP of the system 10.

The refrigeration system 10 also includes a flash gas valve 122 that is configured to receive gas from the tank 116 and provide the gas CO2 to the MT compressor 106 via the conduit 162 and the conduit 164. The flash gas valve 122 may cool the CO2 vapor by reducing a pressure of the CO2 vapor prior to providing the CO2 vapor to the inlet of the MT compressor 106. The flash gas valve 122 may facilitate metering vapor pressure within the tank 116, and can facilitate preventing superheat of the CO2 within the tank 116. When the flash gas valve 122 is opened and the MT compressor 106 operates to compress CO2 for propulsion through the system 10, a pressure of the CO2 at an outlet of the flash gas valve 122 may equalize with a pressure at a suction side of the MT compressor 106.

In some instances, a temperature of CO2 drawn at the MT compressor 106 may increase due to hot superheated vapor being provided by the LT compressor 108. Increasing temperatures can cause the MT compressor 106 to operate at high temperatures for prolonged periods of time, which can disadvantageously affect components of the MT compressor 106 and reduce efficiency or COP of the system 10. For example, if the MT compressor 106 becomes too hot, oil may start burning, which can cause damage to the MT compressor 106 and early equipment failure (e.g., reed failure of the MT compressor 106). The system 10 advantageously uses the IT compressor 104 to divert superheated CO2 from the outlet of the LT compressor 108 to the suction or inlet of the IT compressor 104, instead of providing the superheated CO2 to the suction or inlet of the MT compressor 106. Using the MT compressor 106 and the IT compressor 104 in parallel with the three-way valve 102 that operates to divert the superheated CO2 compressed by the LT compressor 108 facilitates reducing an amount of heat at the MT compressor 106, and thereby reduces a likelihood of failure of the MT compressor 106 (e.g., reduces degradation rate of the MT compressor 106, increases a lifetime of the MT compressor 106, etc.). For example, selectively or automatically diverting the superheated CO2 to the MT compressor 106 and the IT compressor 104 may improve an overall efficiency or COP of the system 10, and reduce a likelihood of compressor failure. The operation of the three-way valve 102 can be performed automatically based on temperature of the CO2 entering the MT compressor 106 or the temperature of the CO2 entering the IT compressor 104 (e.g., temperature of the CO2 as measured at the inlet of the MT compressor 106 or the IT compressor 104). When the three-way valve 102 is in the first position and provides the CO2 to the MT compressor 106, the system 10 may operate as normal, with the MT compressor 106 receiving CO2 from the LT compressor 108 via conduit 164, receiving CO2 from the MT circuit 150 via conduit 160 and conduit 164, and receiving CO2 from the tank 116 via conduit 162 and conduit 164. When the three-way valve 102 is in the second position and provides the CO2 to the IT compressor 104 via conduit 158, the IT compressor 104 may also draw CO2 from the tank 116 via conduit 166.

Pressure-Enthalpy Diagram

Figure 2:
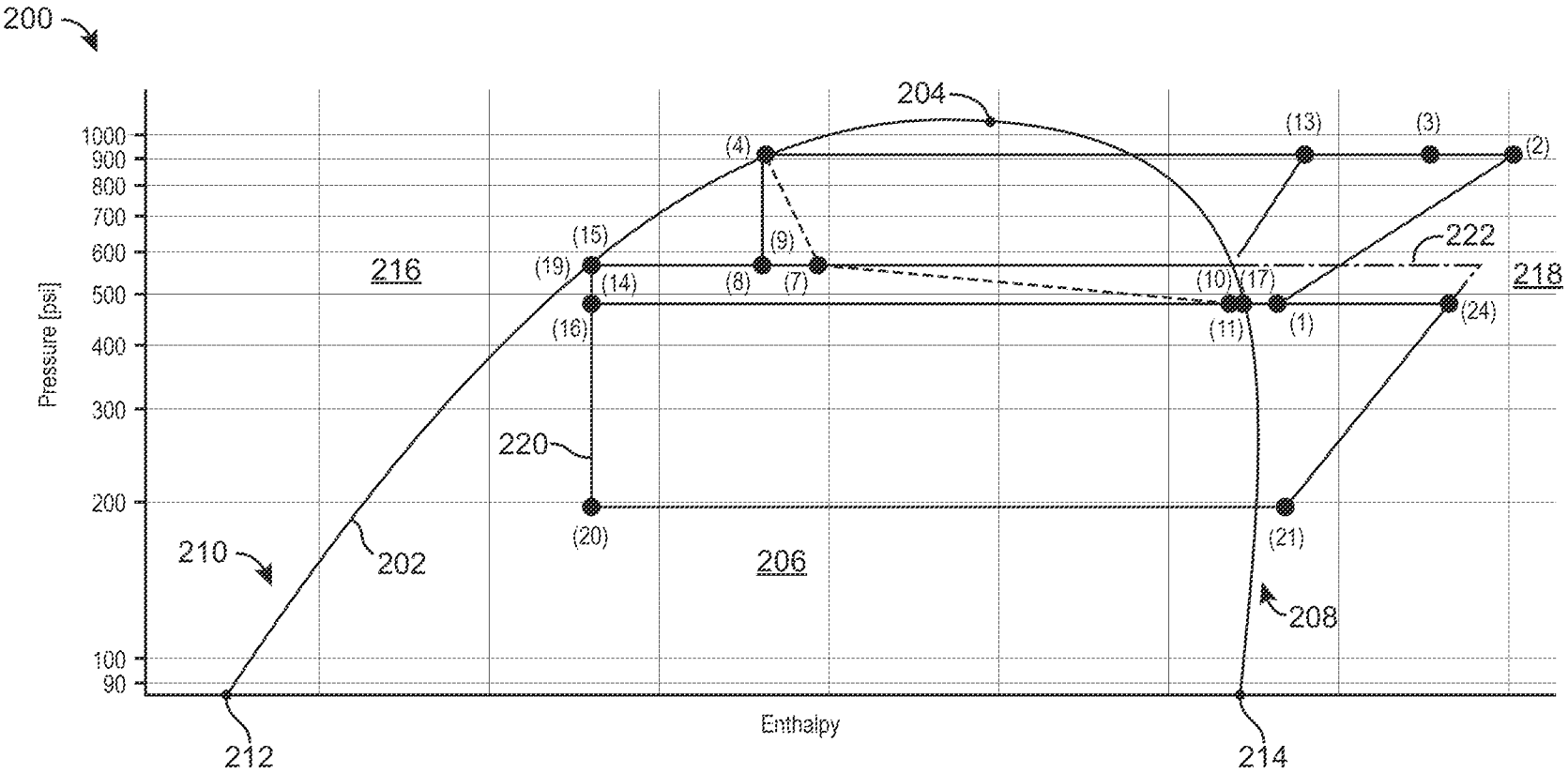
FIG. 2 is a pressure-enthalpy diagram illustrating a compression process of the refrigeration system of FIG. 1, according to some embodiments.

Referring to FIG. 2, a pressure-enthalpy diagram 200 illustrates a thermodynamic process performed by the system 10 of FIG. 1, according to some embodiments. The pressure-enthalpy diagram 200 includes a saturated vapor dome 202 of CO2, having a first point 212, a critical point 204, and a second point 214. Locations 210 along the dome 202 between the critical point 204 and the first point 212 indicate saturated liquid of the CO2. Locations 208 along the dome 202 between the critical point 204 and the second point 214 indicate saturated vapor of the CO2. Locations within an area 206 of the dome 202 indicate a liquid and gas mixture of the CO2. Areas 216 and 218 illustrate subcooled liquid and superheated gas, respectively.

The pressure-enthalpy diagram 200 also includes a process 220 that includes points and associated numbers. The number associated with the different points of the process 220 correspond to the numbers in bubbles as shown in the diagram of the system 10 in FIG. 1. A portion 222 of the process 220 illustrates a change in the process 220 when the three-way valve 102 is operated to divert the CO2 provided by the LT compressor 108 to the IT compressor 104. In some embodiments, the position of the three-way valve 102 is controlled based on temperature of the CO2 downstream of an outlet of the three-way valve 102 (e.g., at the inlet of the MT compressor 106 or at the inlet of the IT compressor 104).

Control System and Control Strategies

Figure 3:
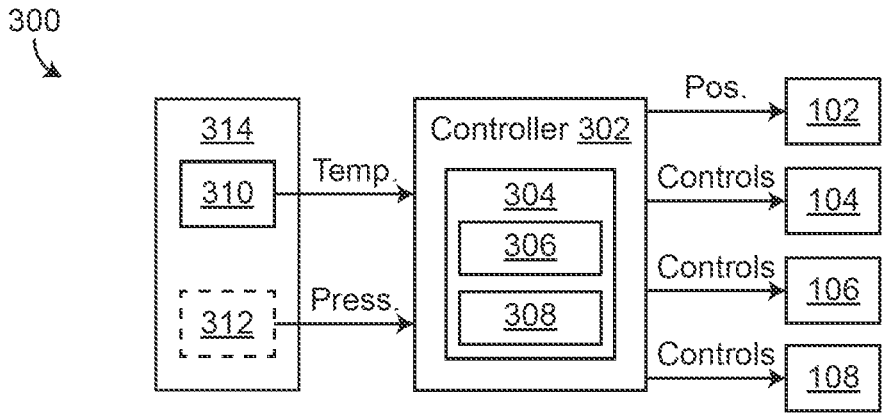
FIG. 3 is a block diagram of a control system for operating the refrigeration system of FIG. 1, according to some embodiments.

Referring to FIG. 3, a diagram of a control system 300 for the system 10 is shown, according to some embodiments. The control system 300 includes a controller 302, a temperature sensor 310, and a pressure sensor 312. The control system 300 also includes the three-way valve 102, the IT compressor 104, the MT compressor 106, and the LT compressor 108.

Still referring to FIG. 3, the controller 302 shown to include processing circuitry 304 including a processor 306 and memory 308. Processing circuitry 304 can be communicably connected to a communications interface such that processing circuitry 304 and the various components thereof can send and receive data via the communications interface. Processor 306 can be implemented as a general purpose processor, an application specific integrated circuit (ASIC), one or more field programmable gate arrays (FPGAs), a group of processing components, or other suitable electronic processing components.

Memory 308 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 308 can be or include volatile memory or non-volatile memory. Memory 308 can include database components, object code components, script components, or any other type of information structure for supporting the various activities and information structures described in the present application. According to some embodiments, memory 308 is communicably connected to processor 306 via processing circuitry 304 and includes computer code for executing (e.g., by processing circuitry 304 and/or processor 306) one or more processes described herein.

In some embodiments, controller 302 is implemented within a single computer (e.g., one server, one housing, etc.). In various other embodiments, controller 302 can be distributed across multiple servers or computers (e.g., that can exist in distributed locations).

Referring still to FIG. 3, the temperature sensor 310 and the pressure sensor 312 may be disposed in a sensing unit 314 (e.g., a housing). In some embodiments, the pressure sensor 312 is optional. The controller 302 is configured to obtain the temperature from the temperature sensor 310 and the pressure from the pressure sensor 312. The control system 300 may include any number of sensing units 314 or temperature sensors 310. As shown in FIG. 1, the sensing unit 314 is positioned downstream of the three-way valve 102 at the inlet of the MT compressor 106 or at the inlet of the IT compressor 104, according to an exemplary embodiment. In other embodiments, the sensing unit 314 can be positioned directly downstream of the LT compressor 108 (e.g., before the three-way valve 102), or upstream of the LT compressor 108 (e.g., directly before the inlet of the LT compressor 108). In some embodiments, the sensing unit 314 may be positioned directly downstream of the LT heat exchanger 134. In some embodiments, the sensing unit 314 is positioned directly upstream of the MT compressor 106 to monitor a temperature of CO2 entering the MT compressor 106. In some embodiments, the sensing unit 314 is positioned anywhere else (e.g., along a conduit) of the system 10. In some embodiments, multiple sensing units 314 are positioned at any of the locations described herein, and the controller 302 may use an average, a weighted average, etc., of the temperature values obtained from throughout the system 10. In some embodiments, the sensing unit 314 includes any of a temperature sensor, a pressure sensor, an enthalpy sensor, a flow rate sensor, a volumetric flow rate sensor, etc., or any combination thereof, and the controller 302 may use the data described herein to control the three-way valve 102, the IT compressor 104, the MT compressor 106, or the LT compressor 108. In some embodiments, the controller 302 is also configured to obtain environmental data (e.g., pressure, temperature, humidity, etc.) surrounding the system 10, zone data (e.g., pressure, temperature, humidity, etc., of any of the medium temperature zone, the low temperature zone, etc.).

The temperature obtained by the controller 302 from the temperature sensor 310 indicates a degree of superheat of the CO2 (e.g., before the CO2 enters the MT compressor 106, after the CO2 exits the three-way valve 102, before the CO2 enters the LT compressor 108, after the CO2 exits the LT heat exchanger 134, etc.). In some embodiments, the controller 302 is also configured to obtain a pressure from the sensing unit 314 for use in determining a superheated phase or a location of the CO2 on the pressure-enthalpy diagram 200.

The controller 302 may also obtain user inputs and use the user inputs to operate any of the three-way valve 102, the IT compressor 104, the MT compressor 106, or the LT compressor 108. For example, the controller 302 may obtain a setpoint temperature for any of the medium temperature zone or the low temperature zone, and adjust operational parameters (e.g., compressor speed) of the IT compressor 104, the MT compressor 106, or the LT compressor 108.

Figure 4:
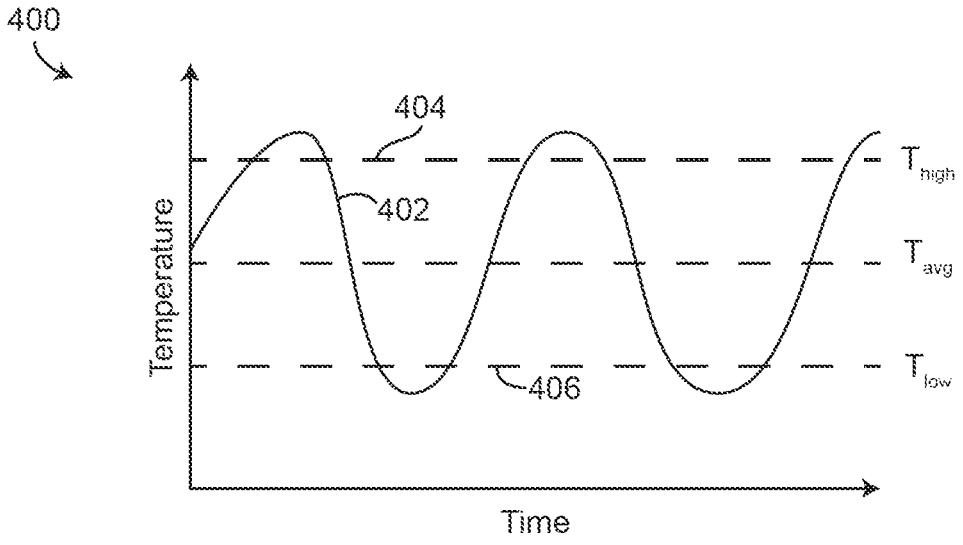
FIG. 4 is a graph illustrating deadband control, according to some embodiments.

Referring to FIGS. 3 and 4, the controller 302 may be configured to use a deadband control technique to transition the three-way valve 102 between the first position and the second posit ion. FIG. 4 illustrates a graph 400 having a series 402 of the temperature obtained from the temperature sensor 310 that illustrates deadband control of the three-way valve 102. The controller 302 may use a first temperature threshold, $T_{high}$ (shown as threshold 404) and a second temperature threshold, $T_{low}$ (shown as threshold 406). The controller 302 can compare the temperature T obtained from the temperature sensor 310. In some embodiments, the controller 302 is configured to compare the temperature T obtained from the temperature sensor 310 to the first temperature threshold $T_{high}$. If the temperature T exceeds the first temperature threshold $T_{high}$ (and/or is equal to the first temperature $T_{high}$, the controller 302 may transition the three-way valve 102 from the first position (where the three-way valve 102 provides the CO2 to the MT compressor 106) into the second position (where the three-way valve 102 provides the CO2 to the IT compressor 104). After the three-way valve 102 is transitioned out of the first position and into the second position, the temperature T may continue increasing for a period of time, and then begin decreasing (e.g., due to time delays, thermal storage of heat, etc.). The controller 302 can monitor the temperature T and, in response to the temperature T decreasing below or being equal to the low temperature $T_{low}$, transition the three-way valve 102 out of the second position and back into the first position. The temperature may then increase, and if the temperature increases to or beyond the high temperature threshold $T_{high}$, the controller 302 transitions the three-way valve 102 out of the first position and back into the second position. The controller 302 can, generally, maintain a current position of the three-way valve 102 if the temperature T is between the high temperature threshold $T_{high}$ and the low temperature threshold $T_{low}$, and change the position of the valve between the first position and the second position in response to the temperature T being greater than or equal to the high temperature threshold $T_{high}$ or in response to the temperature T being lower than or equal to the low temperature threshold $T_{low}$. In some embodiments, the use of deadband control by the controller 302 as illustrated in FIG. 4 facilitates maintaining the temperature T, over a long period of time, at an average temperature $T_{avg}$ that is between the high temperature threshold $T_{high}$ and the low temperature threshold $T_{low}$.

Figure 5:
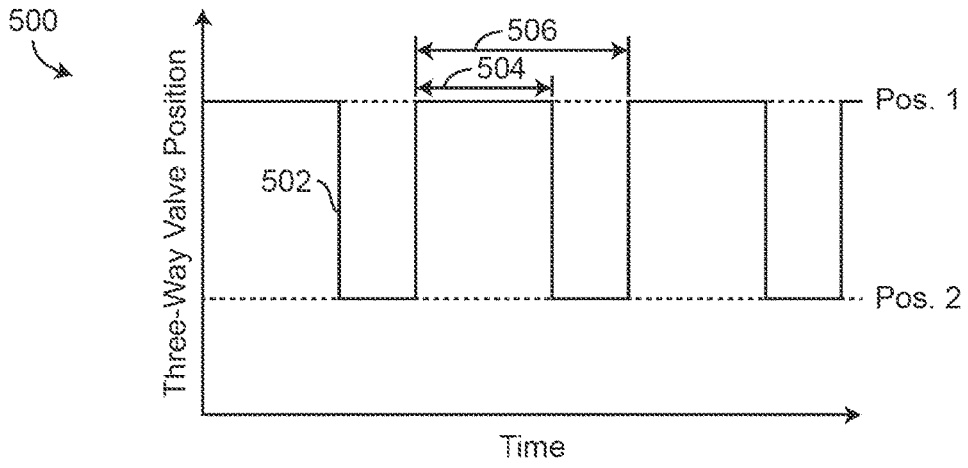
FIG. 5 is a graph illustrating a duty cycle of the three-way valve of the system of FIG. 1, according to some embodiments.

Referring to FIG. 5, a graph 500 illustrates another control strategy that can be implemented by the controller 302, according to some embodiments. The graph 500 includes a series 502 that illustrates the position of the three-way valve 102 over time. Specifically, the abscissa of the graph 500 illustrates time, and the ordinate of the graph 500 illustrates the position of the three-way valve 102. The graph 500 illustrates the series 502 alternating between the first position (illustrated as "Pos. 1") and the second position (illustrated as "Pos. 2"). The series 502 is shown to include a period Δt (e.g., a total amount of time over which the three-way valve 102 is in the first position and the second position over one cycle), shown as period 506 and a pulse width $\Delta t_w$ (e.g., an amount of time the three-way valve 102 is in the first position), shown as 504. In some embodiments, the period Δt and the pulse width $\Delta t_w$ define a duty cycle Duty. The duty cycle Duty may be defined as $$\text{Duty} = \frac{\Delta t_w}{\Delta t}.$$

In some embodiments, the controller 302 is configured to adjust the duty cycle Duty and provide the duty cycle Duty to the three-way valve 102. The controller 302 may adjust the duty cycle Duty based on a time-average temperature of the superheated CO2 so that the time-average temperature of the superheated CO2 is substantially equal to a desired temperature $T_{desired}$ (e.g., the $T_{avg}$ of FIG. 4). In some embodiments, the duty cycle Duty is alternatively defined as a proportion between an amount of time that the three-way valve 102 is in the second position relative to the period Δt.

Referring again to FIG. 3, the controller 302 can also be configured to operate the three-way valve 102 based on predictive data (e.g., seasonalized data) of zone temperatures (e.g., predicted zone temperature, predicted weather data, expected operations, expected setpoints, expected times when heat disturbances are expected to occur due to the medium temperature or low temperature zones being accessed, etc.). The controller 302 can obtain the predictive data from a weather service, a historical data storage service, etc., or may determine the predictive data based on obtained sensor data. In some embodiments, the controller 302 is configured to adjust a setpoint, adjust the duty cycle Duty, adjust the values of the thresholds $T_{high}$ and/or $T_{low}$ based on the predictive data to account for expected conditions.

Referring still to FIG. 3, the controller 302 may implement a control strategy similar to the deadband control as illustrated in FIG. 4, but changing the source of the temperature value illustrated by the series 402 and used by the controller 302 for the control of the three-way valve 102. Specifically, when the three-way valve 102 is in the first position, the controller 302 can obtain temperature from an inlet of the MT compressor 106, and compare the temperature to a first threshold. If the temperature at the inlet of the MT compressor 106 exceeds the first threshold, the controller 302 may transition the three-way valve 102 into the second position. Once the three-way valve 102 is in the second position, the controller 302 may obtain temperature data from an inlet of the IT compressor 104. In response to the temperature at the inlet of the IT compressor 104 exceeding a second threshold temperature, the controller 302 may transition the three-way valve 102 out of the second position and back into the first position. In this way, the controller 302 can obtain temperature data from different locations based on the position of the three-way valve 102.

Process

Figure 6:
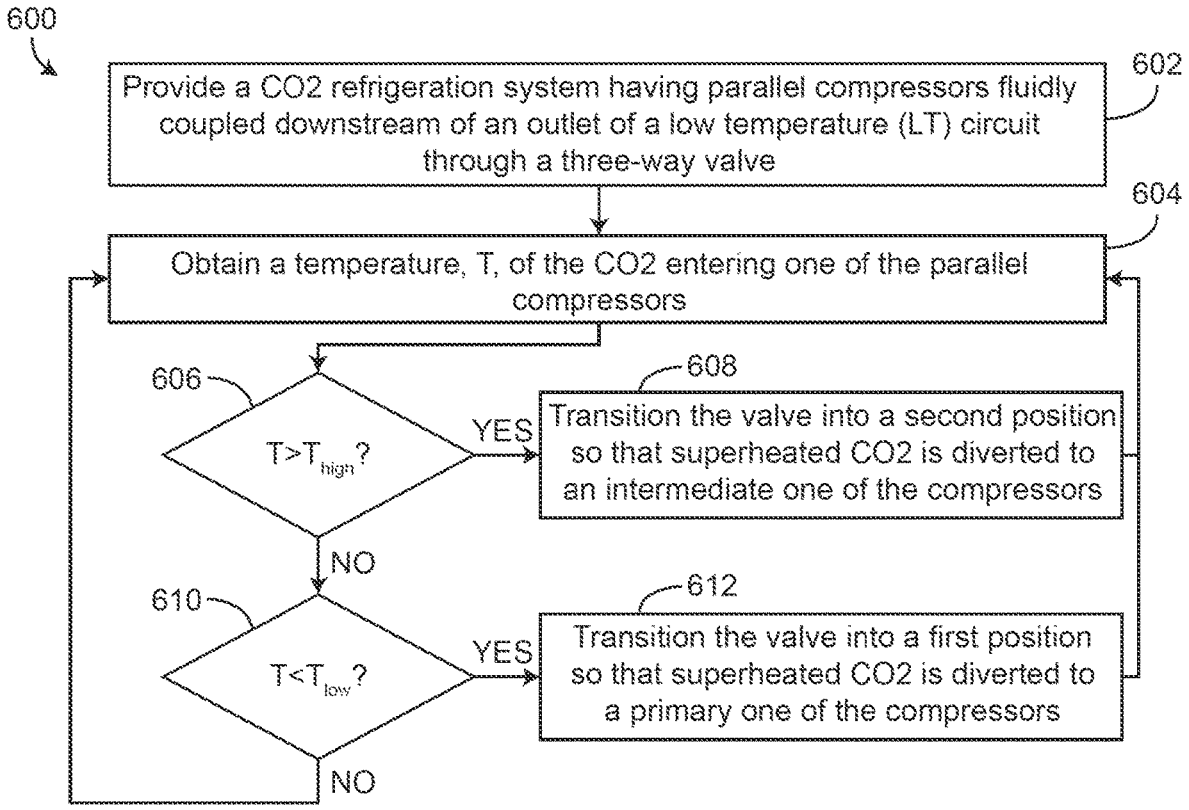
FIG. 6 is a flow diagram of a process for operating the three-way valve of the system of FIG. 1, according to some embodiments.

Referring to FIG. 6, a flow diagram illustrates a process 600 of controlling the three-way valve 102, according to some embodiments. In some embodiments, the process 600 includes steps 602-612. Steps 604-612 can be performed by the control system 300, or more specifically by the processing circuitry 304 of the controller 302.

As shown in FIG. 6, the process 600 includes providing a CO2 refrigeration system having parallel compressors fluidly coupled downstream of a low temperature (LT) circuit through a three-way valve (step 602), according to some embodiments. In some embodiments, the CO2 refrigeration system is the system 10 as described in greater detail above with reference to FIG. 1. It should be understood that the systems and methods described herein are not limited to CO2 refrigeration systems (e.g., systems that use CO2 as a refrigerant) but may also be applied to any applied to systems that use any other refrigerant such as chlorofluorocarbons (CFCs), hydrochlorofluorocarbons (HCFCs), hydrofluorocarbons (HFCs), water, ammonia, R-410A refrigerants, R-407C refrigerants, R-124A refrigerants, R-600 refrigerants, etc., or any other refrigerant with suitable thermodynamic properties. In some embodiments, the CO2 refrigeration system is similar to the system 10 as described in greater detail above insofar as the CO2 refrigeration system includes a cooling circuit (e.g., the LT circuit), and two compressors in parallel that are fluidly coupled downstream of the cooling circuit via a valve that is operable between a first position in which a first of the parallel compressors is fluidly coupled with the cooling circuit through the valve, and a second position in which a second of the parallel compressors is fluidly coupled with the cooling circuit through the valve.

Process 600 includes obtaining a temperature, T, of the CO2 (or more generally, the refrigerant) entering one of the parallel compressors (step 604), according to some embodiments. In some embodiments, the CO2 refrigeration system includes a temperature sensor that is configured to obtain a temperature of the CO2 at a location where the CO2 is expected to be in a superheated phase (e.g., downstream of the three-way valve 102, at an inlet of the MT compressor 106, at an inlet of the IT compressor 104, etc.). In some embodiments, the temperature is an average value of multiple temperature values obtained from a single sensor over a time period, from multiple sensors at a same time, or from multiple sensors across a time period. In some embodiments, step 604 is performed by the controller 302, or the processing circuitry 304 thereof.

Process 600 includes determining if the temperature exceeds a high temperature threshold ($T_{high}$) (step 606), according to some embodiments. In some embodiments, step 606 includes comparing the temperature T obtained in step 604 to the high temperature threshold $T_{high}$ and determining if the temperature T obtained in step 604 is greater than (or greater than or equal to) the high temperature threshold $T_{high}$. If the temperature T is greater than the high temperature threshold $T_{high}$ (step 606, "YES"), process 600 proceeds to step 608. If the temperature T is less than the high temperature threshold $T_{high}$ (step 606, "NO"), process 600 proceeds to step 610. In some embodiments, step 606 is performed by the controller 302, or the processing circuitry 304 thereof.

Process 600 includes determining if the temperature T is less than a low temperature threshold ($T_{low}$) (step 610), according to some embodiments. In some embodiments, step 610 includes comparing the temperature T obtained in step 604 to the low temperature threshold $T_{low}$ and determining if the temperature T obtained in step 604 is less than the low temperature threshold $T_{low}$. In some embodiments, step 610 is performed in response to the temperature T being greater than (or greater than or equal to) the high temperature threshold $T_{high}$ (step 606, "NO"). If the temperature T is greater than the low temperature threshold $T_{low}$ (step 610, "NO"), process 600 returns to step 604. If the temperature T is less than the low temperature threshold $T_{low}$ (step 610, "YES"), process 600 proceeds to step 612. In some embodiments, step 610 is performed by the controller 302, or the processing circuitry 304 thereof.

Process 600 includes transitioning the three-way valve into a first position so that superheated CO2 is directed to a primary one of the parallel compressors (step 612), according to some embodiments. In some embodiments, the primary compressor is the MT compressor 106 of the system 10 as shown in FIG. 1 above. In some embodiments, when the valve is in the first position, the primary compressor receives return CO2 from the cooling/LT circuit, and provides the return CO2 from the cooling/LT circuit to the primary compressor, but not the other of the parallel compressors. In response to performing step 612, the process 600 returns to step 604. In some embodiments, step 612 is performed by the controller 302 or processing circuitry 304 thereof.

Process 600 includes transitioning the three-way valve into a second position so that superheated CO2 is diverted to an intermediate one of the compressors (e.g., in response to step 606, "YES") (step 608), according to some embodiments. In some embodiments, step 608 includes generating control signals for the three-way valve (e.g., the three-way valve 102) and providing the control signals to the three-way valve to transition the three-way valve into the second position. In some embodiments, when the three-way valve is in the second position, the return CO2 from the LT or cooling circuit is fluidly coupled with the intermediate one of the compressors (e.g., the IT compressor 304) through the three-way valve, and the three-way valve limits fluid coupling between the return CO2 and the primary compressor. In some embodiments, step 608 is performed by the controller 302 or processing circuitry 304 thereof.

Configuration of Exemplary Embodiments

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claim.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

What is claimed is:

1. A refrigeration system for cooling a space, the refrigeration system comprising:

a first compressor fluidly coupled with a low temperature heat exchanger, the first compressor configured to receive a refrigerant from the low temperature heat exchanger and pressurize the refrigerant;

a second compressor and a third compressor arranged in a parallel configuration; and a three-way valve fluidly coupled with an outlet of the first compressor and fluidly coupled with an inlet of each of the second compressor and the third compressor, the three-way valve selectively operable between a first position in which the outlet of the first compressor is fluidly coupled with the inlet of the second compressor through the three-way valve, and a second position in which the outlet of the first compressor is fluidly coupled with the inlet of the third compressor through the three-way valve;

wherein the three-way valve is configured to selectively transition between the first position and the second position in response to a temperature of the refrigerant; and wherein refrigerant from the low temperature heat exchanger is returned to a suction side of the first compressor;

wherein refrigerant from a medium temperature heat exchanger is returned through an accumulator to a position upstream of a suction side of the second compressor, downstream of an inlet of the three-way valve, and downstream of a discharge side of the first compressor.

2. The refrigeration system of claim 1, wherein the refrigeration system is a carbon dioxide ($CO_2$) refrigeration system and the refrigerant is ($CO_2$).

3. The refrigeration system of claim 1, wherein both the second compressor and the third compressor are configured to pressurize the refrigerant and provide the refrigerant to both the medium temperature heat exchanger and the low temperature heat exchanger.

4. The refrigeration system of claim 1, further comprising:

a temperature sensor; and a controller configured to:

obtain the temperature from the temperature sensor, the temperature indicating a degree of superheat of the refrigerant;

determine whether the three-way valve should be in the first position or the second position based on the temperature; and operate the three-way valve to transition between the first position and the second position.

5. The refrigeration system of claim 1, wherein the low temperature heat exchanger is provided on a low temperature circuit, wherein the medium temperature heat exchanger is provided on a medium temperature circuit, wherein the low temperature heat exchanger is configured to cool a low temperature zone to a low temperature, and the medium temperature heat exchanger is configured to cool a medium temperature zone to a medium temperature, the low temperature being less than the medium temperature.

6. The refrigeration system of claim 5, wherein the inlet of the second compressor is fluidly coupled with a return of the medium temperature circuit, the second compressor configured to receive refrigerant from the return of the medium temperature circuit when the three-way valve is in the first position and when the three-way valve is in the second position.

7. The refrigeration system of claim 5, wherein the three-way valve is configured to selectively transition between the first position and the second position to provide return refrigerant from the low temperature circuit to the second compressor or the third compressor.

8. The refrigeration system of claim 5, wherein the low temperature zone is a freezer zone of a display case, and the medium temperature zone is a refrigerated zone of the display case.

9. The refrigeration system of claim 1, further comprising a flash tank configured to receive refrigerant from the second compressor and the third compressor, the flash tank configured to provide liquid refrigerant to the low temperature heat exchanger and gaseous refrigerant to the inlet of the second compressor and the inlet of the third compressor downstream of the three-way valve.

10. The refrigeration system of claim 9, further comprising:

a first heat exchanger configured to facilitate heat exchange between refrigerant discharged by the second compressor and the third compressor and the gaseous refrigerant discharged from the flash tank; and a second heat exchanger configured to facilitate heat exchange between refrigerant exiting the low temperature heat exchanger and liquid refrigerant discharged from the flash tank before the liquid refrigerant enters the low temperature heat exchanger.

11. A control system for a refrigeration system, the control system comprising:

a three-way valve, an inlet of the three-way valve configured to fluidly couple with an outlet of a first compressor, the first compressor configured to receive return refrigerant from a heat exchanger, wherein the three-way valve is transitionable between a first position in which the three-way valve provides the refrigerant provided by the first compressor to a second compressor, and a second position in which the three-way valve provides the refrigerant provided by the first compressor to a third compressor, the second compressor and third compressor arranged in parallel;

a temperature sensor configured to measure a temperature indicating a degree of superheat of the refrigerant before entering the second compressor; and a controller configured to:

obtain the temperature from the temperature sensor;

determine a duty cycle based on the temperature, the duty cycle defining a first portion of a time period for the three-way valve to be in the first position and a second portion of the time period for the three-way valve to be in the second position; and operate the three-way valve to transition between the first position and the second position according to the duty cycle.

12. The control system of claim 11, wherein the controller is further configured to:

compare the temperature to a first threshold value;

in response to the temperature exceeding the first threshold value, operate the three-way valve to transition into the second position;

compare the temperature to a second threshold value; and in response to the temperature being less than the second threshold value, operate the three-way valve to transition into the first position.

13. The control system of claim 11, wherein the controller is further configured to:

compare the temperature to a first threshold value and a second threshold value;

in response to the temperature being both less than the first threshold value and greater than the second threshold value, maintain the three-way valve in a current one of the first position or the second position;

in response to the temperature being greater than the first threshold value or less than the second threshold value, operate the three-way valve to transition between the first position and the second position.

14. The control system of claim 11, wherein the temperature sensor is positioned:

downstream of the three-way valve;

at an inlet of the second compressor; or at an inlet of the third compressor.

15. The control system of claim 11, wherein the controller is configured to transition the three-way valve between the first position and the second position to direct superheated refrigerant between the second compressor and the third compressor to reduce a degradation rate of the second compressor.

16. A method for controlling a three-way valve that selectively diverts return refrigerant from a first compressor to a second compressor or a third compressor, the second and third compressor in parallel, the method comprising:

obtaining a temperature of refrigerant entering the second compressor or the third compressor, the temperature indicating a degree of superheat of the refrigerant;

determining a duty cycle based on the temperature, the duty cycle comprising a first portion of a time period for the three-way valve to divert return refrigerant to the second compressor in a first position and a second portion of the time period for the three-way to divert the return refrigerant to the third compressor in a second position;

determining, based on the duty cycle, if the three-way valve should be transitioned into the first position, transitioned into the second position, or maintained in a current one of the first position or the second position; and transitioning the three-way valve into the first position or the second position, or maintaining the three-way valve in the first position or the second position;

wherein in the first position, the first compressor provides the return refrigerant to the second compressor through the three-way valve; and wherein in the second position, the first compressor provides the return refrigerant to the third compressor through the three-way valve.

17. The method of claim 16, wherein determining if the three-way valve should be transitioned into the first position, transitioned into the second position, or maintained in the current one of the first position or the second position comprises:

comparing the temperature to a first threshold and, in response to the temperature exceeding the first threshold and the three-way valve being in the first position, determining that the three-way valve should be transitioned into the second position; and comparing the temperature to a second threshold and, in response to the temperature being less than the second threshold and the three-way valve being in the second position, determining that the three-way valve should be transitioned into the first position.

18. The method of claim 16, wherein the return refrigerant is $CO_2$.

19. The method of claim 16, wherein the temperature is obtained from a temperature sensor positioned downstream of an outlet of the three-way valve.

20. The method of claim 16, wherein transitioning the three-way valve between the first position and the second position to direct the return refrigerant between the second compressor and the third compressor reduces a degradation rate of the second compressor.

* * * * *